US010575635B1

(12) United States Patent
Ward

(10) Patent No.: US 10,575,635 B1
(45) Date of Patent: Mar. 3, 2020

(54) PORTABLE GARMENT CADDY

(71) Applicant: Jaime Ward, Charlotte, NC (US)

(72) Inventor: Jaime Ward, Charlotte, NC (US)

( * ) Notice: Subject to any disclaimer, the term of this patent is extended or adjusted under 35 U.S.C. 154(b) by 0 days.

(21) Appl. No.: 16/193,883

(22) Filed: Nov. 16, 2018

(51) Int. Cl.

| | |
|---|---|
| ***A47B 61/02*** | (2006.01) |
| ***F16M 11/28*** | (2006.01) |
| ***F16M 11/42*** | (2006.01) |
| *A47G 25/06* | (2006.01) |

(52) U.S. Cl.
CPC ..... *A47B 61/02* (2013.01); *F16M 11/28* (2013.01); *F16M 11/42* (2013.01); *A47G 25/06* (2013.01); *F16M 2200/08* (2013.01)

(58) Field of Classification Search
CPC ..... A47B 61/06; A47B 61/02; F16M 11/32; F16M 11/42; F16M 11/28; F16M 2200/08; A47G 25/06
USPC ..... 211/85.3, 85.8, 196, 197; 248/166, 435, 248/170, 171, 173; 223/120, 66, 68, 84
See application file for complete search history.

(56) References Cited

U.S. PATENT DOCUMENTS

| | | | | | |
|---|---|---|---|---|---|
| 352,891 | A * | 11/1886 | Reynolds | A47G 25/66 | 223/95 |
| 496,851 | A * | 5/1893 | Bunker | F16M 11/20 | 248/170 |
| 863,820 | A * | 8/1907 | Wingert | A47G 25/0671 | 223/120 |
| 1,261,363 | A * | 4/1918 | Crist | F16M 11/00 | 248/165 |
| 1,386,775 | A * | 8/1921 | Fulford | A47G 25/06 | 211/35 |
| 1,450,416 | A * | 4/1923 | Freshour | A47F 5/06 | 223/120 |
| 1,525,701 | A * | 2/1925 | Rose | A47G 25/0664 | 211/196 |
| 1,621,329 | A * | 3/1927 | Malone | A63B 55/10 | 206/315.7 |
| 1,804,069 | A * | 5/1931 | Stover | A47G 25/0671 | 211/1 |
| 1,863,442 | A * | 6/1932 | Goodman | E01F 9/688 | 116/63 R |
| 1,894,695 | A * | 1/1933 | Ley | F16M 11/10 | 248/171 |
| 2,122,852 | A * | 7/1938 | Llewellyn | A47G 25/56 | 223/120 |
| 2,341,424 | A * | 2/1944 | Chason | A41H 5/00 | 223/120 |

(Continued)

*Primary Examiner* — Jonathan Liu
*Assistant Examiner* — Devin K Barnett
(74) *Attorney, Agent, or Firm* — Sanchelima & Associates, P.A.; Christian Sanchelima; Jesus Sanchelima

(57) ABSTRACT

The present invention discloses a portable garment caddy configured to support a plurality of garments or garment bags. The portable garment caddy comprises a tripod base assembly, a central rod, and a rack assembly. The tripod base assembly comprises a base, at least three legs extending from the base and a telescoping wheel assembly disposed at a lower portion of each leg, wherein the telescoping wheel assembly comprises one or more telescoping wheel supports and wheels. The central rod extending from the tripod base assembly comprises a telescoping configuration to adjust the length of the central rod. The rack assembly extending from the central rod comprises one or more holder members. Advantageously, the garment caddy of the present invention is portable or easily transportable and could be stored in a fully collapsed position as a low-profile unit.

2 Claims, 4 Drawing Sheets

(56) References Cited

U.S. PATENT DOCUMENTS 2,492,226 A * 12/1949 Kohl ..... A47G 25/743 211/113
2,508,122 A * 5/1950 Mooney ..... F16M 11/28 188/74
2,531,131 A * 11/1950 Johnson ..... A47J 47/16 248/129
2,604,214 A * 7/1952 Fussell ..... A47F 7/24 211/165
2,631,802 A * 3/1953 Tunis ..... A47F 5/06 108/159
2,646,956 A * 7/1953 Cadwell ..... F16M 11/28 248/170
2,708,324 A * 5/1955 Wedden ..... A47G 33/06 211/1
2,744,712 A * 5/1956 Brandt ..... A47B 97/08 108/11
2,919,501 A * 1/1960 Settler ..... A47F 8/02 223/120
3,064,932 A * 11/1962 Holderman ..... F16M 11/28 248/171
3,164,349 A * 1/1965 Armstrong ..... G03B 21/58 160/24
3,363,777 A 1/1968 Cooper
3,464,664 A * 9/1969 Nugent ..... A47G 25/0664 211/172
3,804,355 A * 4/1974 Uroshevich ..... F16M 11/16 248/124.1
3,955,722 A * 5/1976 Bard ..... D05C 1/04 223/106
4,562,983 A * 1/1986 Klefbeck ..... B65B 67/12 248/97
4,744,536 A * 5/1988 Bancalari ..... A61M 5/1415 248/125.8
4,807,837 A * 2/1989 Gawlik ..... A61M 5/1415 211/196
4,892,279 A * 1/1990 Lafferty ..... A61M 5/1415 248/125.8
4,895,261 A * 1/1990 Yacobian ..... A47F 5/04 211/167
4,958,793 A * 9/1990 Hess ..... F16M 11/14 248/125.9
4,988,064 A * 1/1991 Hoshino ..... F16M 11/046 248/165
5,083,807 A * 1/1992 Bobb ..... A61G 5/10 248/231.51
5,094,418 A * 3/1992 McBarnes, Jr. ..... A61G 7/0503 248/125.1
D326,374 S * 5/1992 Townsend ..... 211/205
5,288,093 A * 2/1994 Gross ..... A61G 5/10 248/230.6
5,330,143 A * 7/1994 Rich ..... D05C 1/02 223/120
5,458,305 A * 10/1995 Woodward ..... A61M 5/1415 248/121
5,501,376 A * 3/1996 Roda-Balzarini ..... A47G 25/90 223/111
5,509,629 A * 4/1996 Sassmannshausen ..... F16M 11/16 248/169
D372,533 S * 8/1996 Davis ..... 211/205
5,819,961 A * 10/1998 Harris ..... A47G 25/0671 211/196
5,876,011 A * 3/1999 Biasing ..... F16M 11/28 248/170
6,056,249 A * 5/2000 Fillon, Jr. ..... A61M 5/1415 248/125.7
6,073,783 A * 6/2000 Allman ..... D06F 59/02 211/85.3
D435,365 S * 12/2000 Eason ..... D16/244
6,196,429 B1 * 3/2001 Cavdek ..... A41H 5/00 223/120
6,216,886 B1 * 4/2001 Considine ..... A47F 5/06 211/196
6,283,421 B1 * 9/2001 Eason ..... G10G 5/00 248/170
6,375,135 B1 * 4/2002 Eason ..... F16M 11/16 248/163.1
D457,239 S * 5/2002 Kunik ..... D24/128
6,419,246 B1 * 7/2002 Neal ..... B62B 5/0083 280/47.34
6,619,599 B2 * 9/2003 Elliott ..... A61M 5/1415 248/125.8
6,725,970 B2 * 4/2004 Garofalo ..... A01M 31/02 182/115
7,077,276 B1 * 7/2006 Romano ..... D06F 57/04 211/118
7,624,953 B2 * 12/2009 Silverman ..... A61M 5/1415 248/125.1
7,798,456 B2 * 9/2010 Newkirk ..... A61G 7/0503 248/218.4
7,845,656 B2 * 12/2010 Thompson ..... B25H 3/00 280/47.35
7,909,186 B1 * 3/2011 Contreras ..... A47G 25/32 211/124
7,935,030 B1 * 5/2011 Nesbitt ..... A61H 3/04 482/142
8,016,133 B1 * 9/2011 Calabrisotto ..... A47B 61/00 211/85.3
8,020,716 B2 * 9/2011 Vitale ..... A47B 57/06 211/197
8,104,729 B2 * 1/2012 Walke ..... A61G 12/002 248/125.1
8,172,077 B1 * 5/2012 Gray ..... B25H 1/04 190/107
8,322,666 B2 * 12/2012 Duemmel ..... A45B 11/00 248/163.1
8,418,860 B2 * 4/2013 Rimmer ..... D06F 57/08 211/196
8,540,087 B1 * 9/2013 Skaer ..... A47G 25/0685 211/100
8,567,730 B1 * 10/2013 Stevenson ..... A61M 5/1415 248/125.8
8,777,025 B1 * 7/2014 Buckleitner ..... A47F 5/04 211/13.1
8,777,168 B2 * 7/2014 Hassid ..... A47G 25/90 211/85.3
8,789,729 B2 * 7/2014 Beckett ..... D06F 59/02 223/120
9,060,469 B2 * 6/2015 Kamon, II ..... A01G 9/124
9,625,085 B1 * 4/2017 Jones ..... B25H 1/08
10,271,641 B2 * 4/2019 Rassat ..... A47B 13/023
10,299,875 B2 * 5/2019 Schoenig ..... A61G 7/0503
2002/0056792 A1 * 5/2002 Ibrahim ..... F16M 11/34 248/163.1
2002/0070319 A1 * 6/2002 Yu ..... G10G 5/00 248/122.1
2002/0096608 A1 * 7/2002 Cedarberg, III .... A61M 5/1418 248/125.3
2003/0164348 A1 * 9/2003 Seng ..... D06F 57/04 211/196
2003/0213761 A1 * 11/2003 Sparkowski ..... A47F 13/085 211/85.3
2005/0082244 A1 * 4/2005 Ho ..... A47G 7/041 211/85.23
2007/0080268 A1 * 4/2007 Worrell ..... E04F 21/06 248/177.1
2007/0175848 A1 * 8/2007 Mallen ..... A47G 25/0671 211/196
2008/0283692 A1 * 11/2008 Leinen ..... A61M 5/1415 248/125.8
2009/0071922 A1 * 3/2009 Barra ..... F16M 11/28 211/85.3
2009/0173758 A1 * 7/2009 Hahn ..... D06F 57/02 223/85
2009/0184073 A1 * 7/2009 Lu ..... A47B 61/003 211/85.3

(56) References Cited

U.S. PATENT DOCUMENTS

2010/0243829 A1* 9/2010 Stephens-De Alanis ..... A45D 44/00 248/158
2011/0036794 A1* 2/2011 Schott ..... A47G 25/0671 211/85.3
2011/0056898 A1* 3/2011 Foley ..... A47B 23/046 211/85.8
2011/0122605 A1* 5/2011 Deighton ..... F16M 11/28 362/183
2012/0055893 A1* 3/2012 Wisniewski ..... A47G 25/0664 211/85.3
2012/0138557 A1* 6/2012 Lee ..... D06F 57/06 211/85.3
2013/0037503 A1* 2/2013 Cimino ..... A47G 25/0664 211/85.3
2013/0082016 A1* 4/2013 Arrow ..... A47G 25/0671 211/85.1
2013/0270462 A1* 10/2013 Beck ..... A61B 6/4423 250/516.1
2015/0083678 A1* 3/2015 Baughman ..... G09F 15/0056 211/85.3
2015/0136918 A1* 5/2015 Sjoblom ..... A61M 5/1415 248/158
2015/0233522 A1* 8/2015 Kallas ..... F16M 11/2021 248/170
2015/0282614 A1* 10/2015 Wyner ..... A47B 61/003 211/85.3
2016/0128480 A1* 5/2016 Stevens ..... A47B 97/08 248/451
2017/0261151 A1* 9/2017 Hsu ..... F16B 33/02
2017/0318958 A1* 11/2017 Asante ..... A47B 19/06
2017/0363247 A1* 12/2017 Koehler ..... A61M 5/1417

* cited by examiner

PORTABLE GARMENT CADDY

BACKGROUND OF THE INVENTION

1. Field of the Invention

The present disclosure relates to a garment caddy. More particularly, the present disclosure relates to a portable garment caddy to support or hang a plurality of clothes, garment bags or heavy-duty garment bags.

2. Description of the Related Art

Cloth caddies are generally used for temporary storage of clothes in personal or institutional settings. For example, when transporting heavy duty garment bags, it is convenient to have the cloth caddy on which the clothes could be hung and transported. In another example, in garment sales trade and fashion industry, cloth caddy could be used for transporting and displaying clothes for sales or marketing. Most cloth caddy or rack, which have been used for this purpose are large, heavy and bulky requiring a user to exercise strength in controlling the caddy during transport. Further, the user cannot readily transport the rack along with the heavy-duty garment bags.

Several devices have been designed in the past. None of them, however, include a portable garment caddy that is capable of addressing the foregoing discussed issues.

Applicant believes that a related reference corresponds to U.S. Pat. No. 1,261,363A filed by Joseph R Crist describes a clothes-rack. The Joseph reference discloses a portable clothes stand capable of being conveniently carried in a trunk, satchel or suitcase. The stand comprises a trunk or body portion formed by a plurality of sections arranged in such manner to permit folding or collapsing to occupy a small amount of space. Further, the Joseph reference aims to provide improved means for detachably connecting rack members and legs to the said body and a hook. However, the Joseph reference lacks to provide a solution for effortlessly transporting the stand.

Another related reference, U.S. Pat. No. 3,363,777A filed by Samuel I Cooper discloses a clothes caddy. The Samuel reference discloses a clothes caddy comprising a stand and a garment supporting means. The garment supporting means is pivotally attached to the stand for movement from a side by side relation to support garments. However, the Samuel reference also lacks to provide a solution for effortlessly transporting the stand.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a portable garment caddy configured to support or hang a plurality of clothes, garment bags or heavy-duty garment bags.

It is another object of the present invention to provide a portable garment caddy that is easily transportable and could be stored in a fully collapsed position.

It is yet another object of the present invention to provide a portable garment caddy of economical construction and simple operation.

It is yet another object of the present invention to provide a portable garment caddy comprising a tripod base assembly, a central rod assembly extending vertically from the tripod base assembly and a rack assembly extending from the central rod assembly.

It is yet another object of the present invention to provide a tripod assembly for transporting the portable garment caddy, comprising a base, at least three legs extending from the base and a telescoping wheel assembly disposed at a lower portion of each leg.

It is yet another object of the present invention to provide a rack member comprising one or more holder members to support or hang a plurality of clothes or garment bags.

It is yet another object of the present invention to provide a central rod assembly comprising a collapsible configuration or telescopic configuration to easily store the portable garment caddy.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
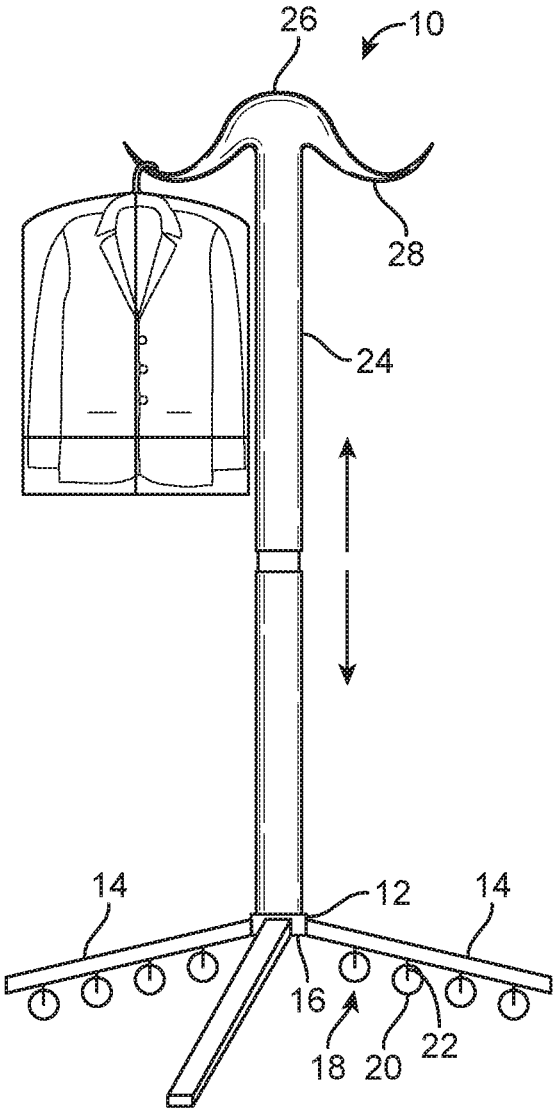
FIG. 1 exemplarily illustrates a portable garment caddy 10 in an embodiment of the present invention. The portable garment caddy 10 comprises a tripod base assembly 12, a central rod assembly 24 extending vertically from the tripod base assembly 12 and a rack assembly 26 extending from the central rod assembly 24, is illustrated.
Figure 2:
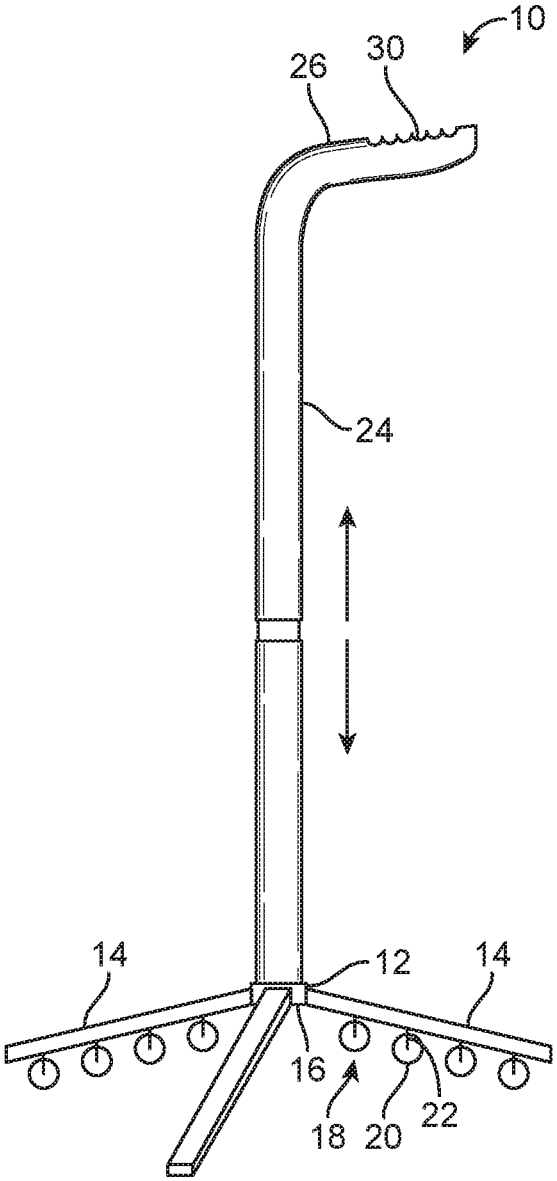
FIG. 2 exemplarily illustrates the portable garment caddy 10 in another embodiment of the present invention. The rack assembly 26 comprising one or more hooks 30, is illustrated.
Figure 3:
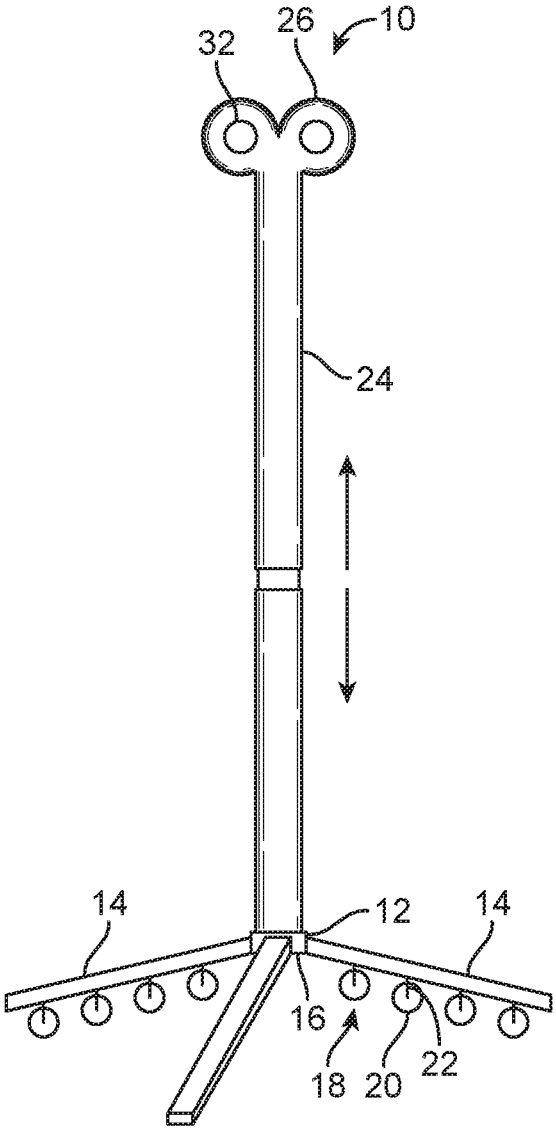
FIG. 3 exemplarily illustrates the portable garment caddy 10 in yet another embodiment of the present invention. The rack assembly 26 comprising one or more apertures 32, is illustrated.
Figure 4:
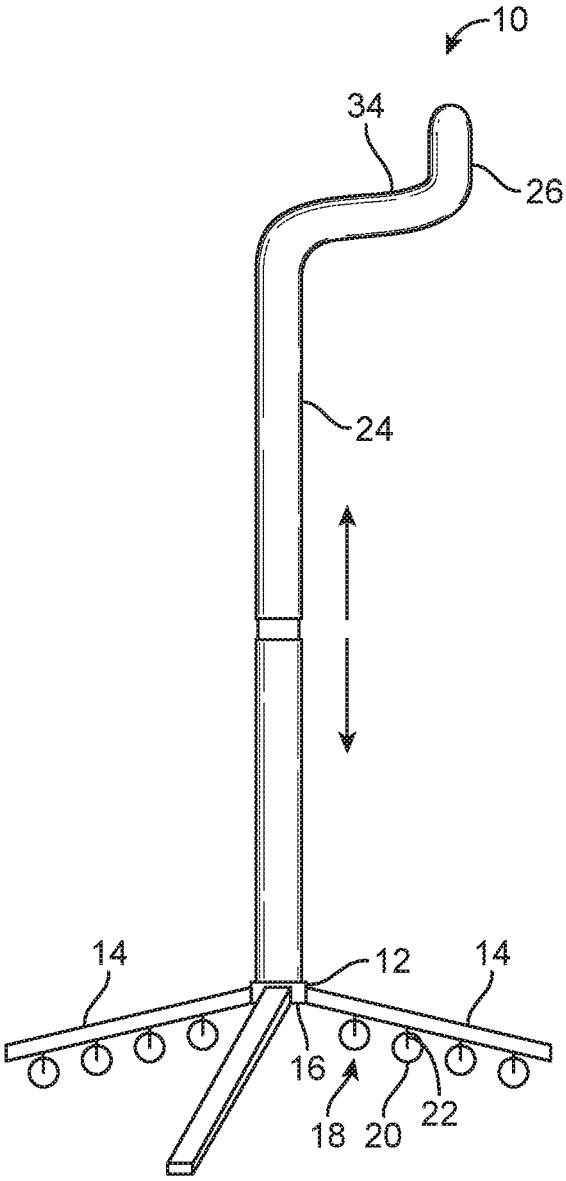
FIG. 4 exemplarily illustrates the portable garment caddy 10 in yet another embodiment of the present invention. The rack assembly 26 comprising a hook-shaped configuration 34, is illustrated.

Referring now to the drawings, FIGS. 1-4, where the present invention is generally referred with numeral 10, it can be observed that a portable garment caddy 10 to support a plurality of clothes, garment bags or heavy-duty garment bags, is disclosed.

The portable garment caddy 10 comprises a tripod base assembly 12, a central rod assembly 24 and a rack assembly 26. The tripod base assembly 12 comprises a base 16, at least three legs 14 extending from the base 16 and a telescoping wheel assembly 18. In one embodiment, at least three legs 14 are configured to move between a closed position and an open position. In the closed position, the legs 14 are retracted to form a monopod. In the open position, the legs 14 are extended outwardly. The telescoping wheel assembly 18 comprises a plurality of a telescoping wheel supports 22 and wheels 20.

The central rod assembly 24 extends vertically from the tripod base assembly 12. In one embodiment, the central rod assembly 24 comprises a telescoping configuration to vary or adjust the length of the central rod assembly 24. In another embodiment, the central rod assembly 24 comprises a collapsible configuration.

In one embodiment, the rack assembly 26 extends from the central rod assembly 24. The rack assembly 26 comprises one or more holder members. In one embodiment, the holder member comprises one or more apertures 32. In another embodiment, the holder member is a horizontal member 26 including a hook-shaped member at opposite ends. In yet another embodiment, the holder member comprises one or more hooks 30. In yet another embodiment, the holder member comprises a hook-shaped configuration 34.

During use of the portable garment caddy 10, at least three legs 14 are extended outwards and supported on a horizontal surface or a ground surface. User could support the garments or garment bags, and could transport the garment caddy 10 to a desired location by applying a minimum force on the garment caddy 10. On application of minimum force, the garment caddy 10 is rolled utilizing the plurality of wheels 20. For storage of the portable garment caddy 10, the central rod assembly 24 is collapsed and the at least three legs 14 are retracted to form a compact low-profile unit.

In one embodiment, the garment caddy 10 is made of aluminium or plastic material. In another embodiment, the garment caddy 10 is made of one or more materials including, but not limited to, plastics, steel, aluminium or other similar material. In one embodiment, the garment caddy 10 is 3.5 ft in height. In one embodiment, a base of the garment caddy 10 is 1.5 ft in length and 1.5 ft in width. In one embodiment, the garment caddy 10 comprises maximum hanging capacity. In another embodiment, the garment caddy 10 could be produced in different color and print configuration. In another embodiment, the garment caddy 10 could be manufactured in varying dimensions. In another embodiment, the holder member could be any type of garment holder, fasteners or clips capable of holding one or more garments or garment bags.

Advantageously, the garment caddy 10 of the present invention is easily transportable and could be stored in a fully collapsed position as a low-profile unit. The garment caddy 10 further comprises an economical, light-weight construction, and simple in operation to store and transport one or more garments or garment bags. The garment caddy 10 is suitable for any consumer and institutions, such as hotels, nursing homes, assisted living centers, and community shelters.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A portable garment caddy, comprising:

a tripod base assembly having a base and three legs that slopes downwardly from the base and a wheel assembly disposed on a bottom surface of each of at least two legs from said three legs, wherein each wheel assembly is an integral part of said at least two legs respectively, wherein each wheel assembly includes a plurality of spaced wheels that extend along the slope of each of the at least two legs respectively;

a height adjustable telescopic central rod that extends upwardly from the tripod base assembly, wherein said central rod includes a first portion and a second portion, wherein said central rod includes a central portion mounted between said first portion and said second portion, wherein said central portion has a first diameter that is less than a second diameter of said first portion and a third diameter of said second portion; and a rack assembly that extends from a top end of said central rod, wherein said rack assembly includes two hooks for holding a clothes hanger and a garment bag, wherein said two hooks are an integral part of said top end of said central rod, wherein said two hooks are placed directly opposite of one another, wherein said two hooks each include a first end and a second end, wherein each first end is an integral part of said top end of said central rod, wherein each second end is a hook end, wherein said two hooks each form a curve from each first end to each second end respectively, wherein each second end of each hook is below each first end of each hook respectively, wherein said two hooks extend outwardly a length that is less than the length of said three legs, wherein a top surface of said rack assembly has an arcuate shape.

2. The portable garment caddy of claim 1, is made of at least one of an aluminium or plastic material.

* * * * *